United States Patent [19]

Brainkel et al.

[11] 4,286,310

[45] Aug. 25, 1981

[54] LANTERN FED BY AN ELECTRIC BATTERY

[75] Inventors: Gérard Brainkel, Elbeuf; Alain Battarel, St. Aubin les Elbeuf, both of France

[73] Assignee: Compagnie Industrielle des Piles Electriques "Cipel", Levallois-Perret, France

[21] Appl. No.: 78,677

[22] Filed: Sep. 25, 1979

[30] Foreign Application Priority Data

Oct. 20, 1978 [FR] France ..... 78 29903

[51] Int. Cl.[3] ..... F21L 7/00

[52] U.S. Cl. ..... 362/203; 362/186; 362/205

[58] Field of Search ..... 362/186, 203, 205

[56] References Cited

U.S. PATENT DOCUMENTS 3,087,052 4/1963 Torgerson ..... 362/194

*Primary Examiner*—Stephen J. Lechert, Jr.

*Attorney, Agent, or Firm*—Kenyon & Kenyon

[57] ABSTRACT

The invention relates to a lantern whose housing (1) includes two superposed compartments (4, 5), the first of which (4) contains a light bulb (7) and the second of which (5) contains a single-cell or multi-cell battery (8), switching means being provided for switching the light bulb (7) on and off.

In accordance with the invention, the housing (1) has a one-piece structure without a bottom, at least one portion of the casing of the battery co-operating with the inner surface of the second compartment (5) to guide the battery (8) when it is being inserted in the housing (1) and then to switch said light bulb (7) on and off.

Application to lanterns on work sites.

11 Claims, 5 Drawing Figures

LANTERN FED BY AN ELECTRIC BATTERY

Figure 1:
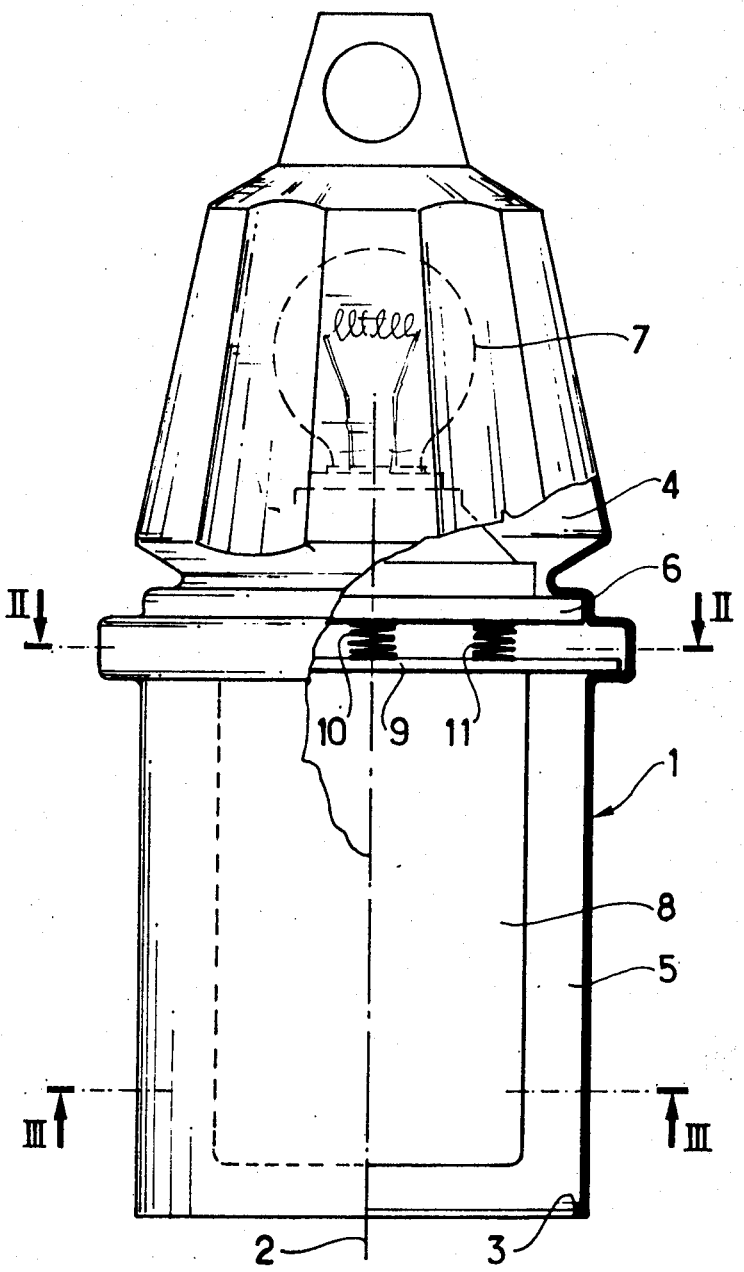

The present invention relates to a lantern fed by an electric single-cell or multi-cell battery and in particular to a lantern used on work sites.

Such a lantern generally includes a closed housing with two superposed compartments—an upper compartment and a lower compartment—the upper compartment containing a light bulb and the lower compartment containing an electric battery, switching means being provided outside the housing for switching the light bulb on or off. The switching means can be of the push-button type, pivoting type or the like. In other types of lantern, the two compartments of the housing are coaxial and rotate with respect to each other and the light bulb can be switched on and off by relative movement of the two compartments of the housing.

The drawback common to these known lanterns is that their switching means are conspicuous from the outside and are readily accessible to passers by; the problem is particularly serious when these lanterns are used for lighting work sites.

The present invention aims to provide a lantern which includes switching means which are difficult to detect by people who have not learnt to use them.

The present invention provides a lantern fed by an electric battery, said lantern comprising a one-piece bottomless housing which has a first compartment and a second compartment which are superposed and contain, respectively, a light bulb and a battery, said light bulb being fixed on a support plate one of whose surfaces is located in the second compartment and bears two electric contacts connected to supply electricity to the light bulb, from terminals on the upper surface of the battery, when the battery is in an operative position inside the housing, at least a portion of the casing of the battery being arranged to co-operate with the inside surface of the second compartment to guide the battery in a first step along a substantially vertical axis for inserting the battery into the housing, and then to guide the battery in a second step of rotation about said axis up to a stop which holds the battery in its operative position where said terminals are brought into contact with said contacts.

In accordance with a particularly advantageous embodiment, the upper surface of the battery includes an insulating plate which carries two terminals in the form of springs and has at least one protruding portion which acts as a guide means for inserting the battery.

The edge of said protruding portion can be notched, so that it slides on a longitudinal rib inside the housing and parallel to said axis when the battery is inserted in the housing. When the lower surface of the protruding portion reaches a boss which corresponds to a position in which the springs are pressed hard against the light-bulb support plate, the battery is again guided, this time about the axis, the lower surface of the protruding portion resting against a plane portion which is at right-angles to the axis and the springs being only slightly compressed. The protruding portion can slide on the plane portion up to a stop which corresponds to the position where said light bulb contacts are put into contact with the two terminals of the battery.

The light bulb is switched off, and the battery is removed from the housing by opposite operations.

Therefore, the lantern in accordance with the invention includes a one-piece housing with no conspicuous switching means. Only a person who has been taught would have the idea of guiding the battery as described hereinabove.

Further, the one-piece housing of the lantern of the invention and its internal guide means can easily be manufactured in a plastics material by extrusion blow molding. This greatly reduces production costs.

Figure 2:
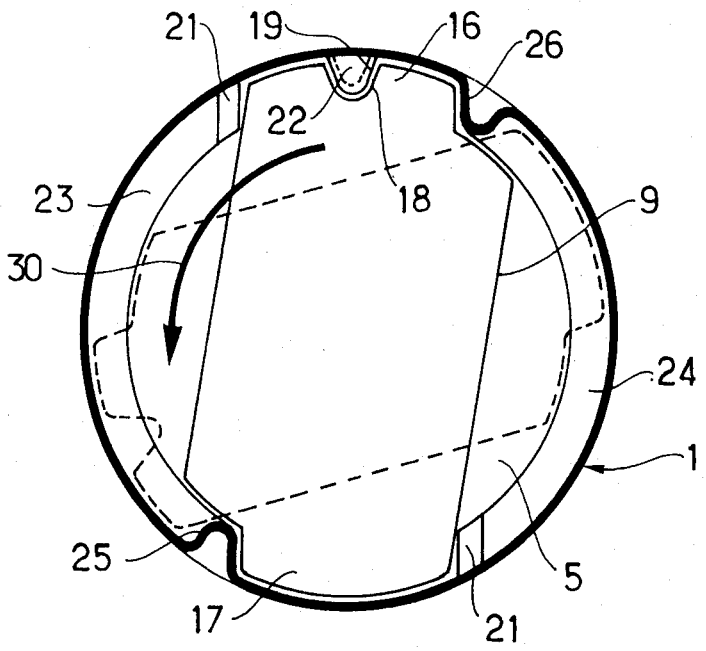
Figure 3:
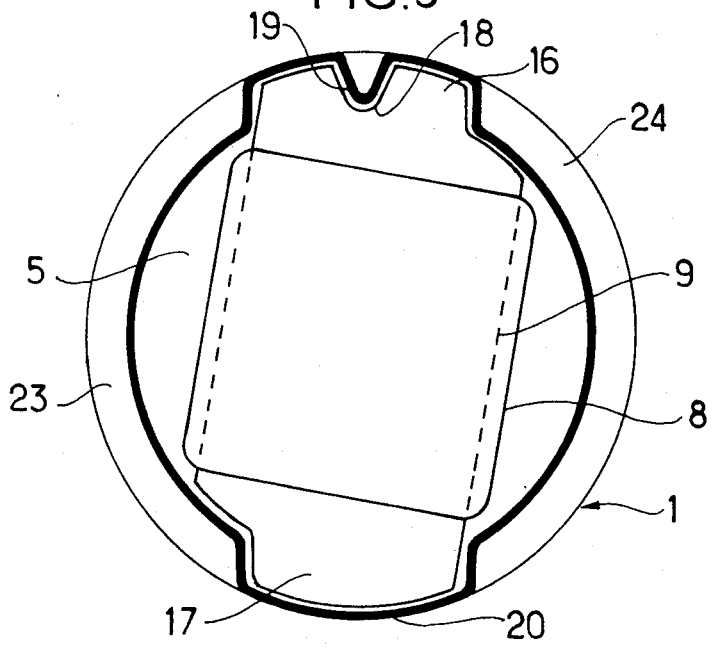
Figure 4:
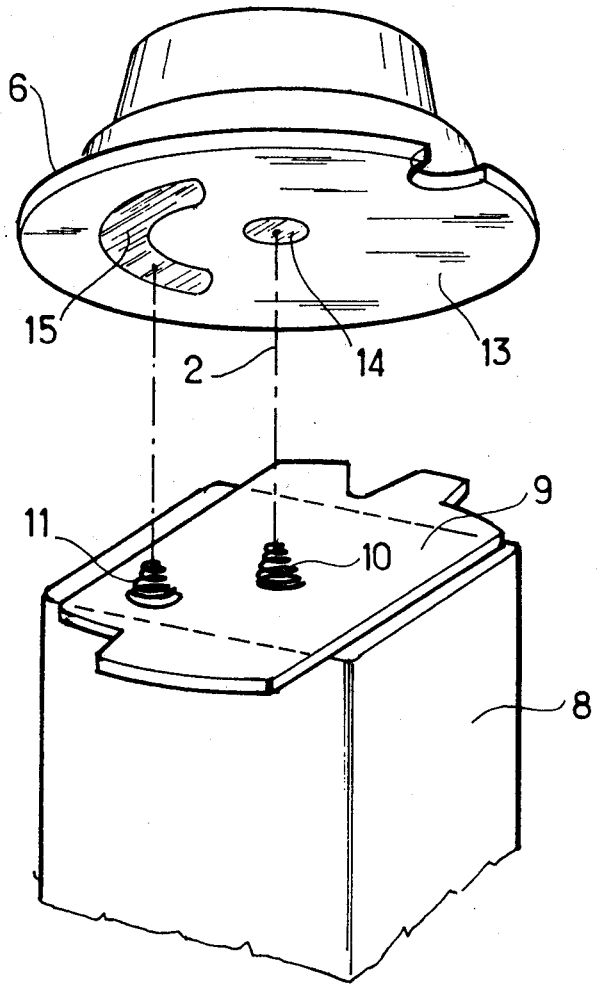
Figure 5:
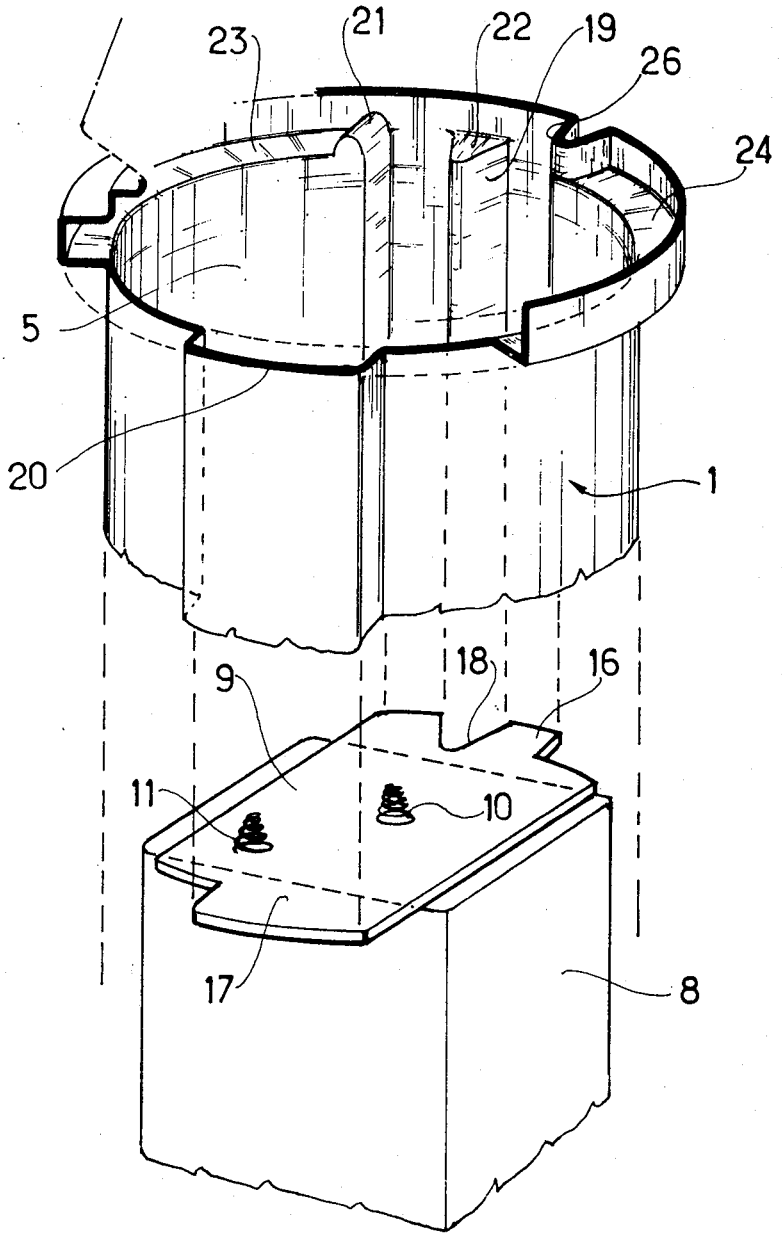

An embodiment of the invention is described with reference to the accompanying drawings, in which:

FIG. 1 is a partially cut-away elevation of a lantern which embodies the invention, FIGS. 2 and 3 are cross-sections respectively through lines II—II and III—III of FIG. 1, FIG. 4 is a partial exploded perspective view of the battery and of the light-bulb support plate fitted inside the lantern of FIG. 1; and FIG. 5 illustrates schematically in perspective the step in which a battery is inserted in the lantern of FIG. 1.

Firstly, it should be observed that the words "lower" and "upper" used in this specification correspond to the usual position in use of the lantern.

The lantern illustrated in FIG. 1 includes a housing 1 made of plastics material. Its shape is generally circular about a vertical axis 2, and it is open at its lower end 3. An intermediate plate 6 divides the housing into two superposed compartments 4 and 5. The upper compartment 4 contains an electric bulb 7 fixed on the upper surface of the plate 6. The lower compartment 5 contains a single-cell or multi-cell battery 8 whose upper surface has an insulating plate 9 which bears two terminals 10 and 11. These two terminals are constituted by springs, one of which, 10, is located at the center of the plate 9 and on the axis 2.

As seen more clearly from FIG. 4, the terminals 10 and 11 are designed to be put in contact respectively with electric contacts 14 and 15 carried by the lower surface 13 of the plate 6 and connected respectively in a known manner to the socket and to the base of the bulb 7.

On referring to FIG. 5, it is apparent that the plate 9 of the battery 8 includes two diametrically opposed protruding portions 16 and 17. The protruding portion 16 has a guiding and positioning notch 18 which can slide on a rib 19 on the inside surface of the compartment 5, the rib being longitudinal and parallel to the axis 2. The protruding portion 17 can slide in a groove 20 in the inside surface of the compartment 5, the groove also being longitudinal and parallel to the axis 2. The inside surface of the compartment 5 also includes a boss 21 located at a higher level than that of the end surface 22 of the rib 19, a first plane portion 23 at right-angles to the axis 2, said plane portion being located at a level lower than that of the boss 21, and a second plane portion 24 which is symmetrical to the first plane portion 23 with respect to the axis 2; lastly, it has two stops in the form of ribs 25 (see FIG. 2) and 26.

In FIGS. 2 and 3 the continuous lines show the cross-sections of the battery 8 and of its plate 9 in the positions they occupy when the battery is inserted into the housing 1 through the open end 3. The notch 18 and the protruding portion 17 allow the battery to be guided into the compartment 5 until the lower surface of the plate 9 reaches the boss 21, a position in which the springs 10 and 11 are tightly compressed against the plate 6. The spring 10 is then in contact with the contact 14, but the spring 11 is not in contact with the contact 15 and the bulb 7 is switched off.

By a rotational movement about the axis 2 in the direction of the arrow 30 in FIG. 2 away from the stop 26, the protruding portion 16 passes beyond the boss 21 and bears against the plane portion 23 on which it can slide up to the stop 25 (this limit position is illustrated in dashed lines in FIG. 2). The protruding portion 17 then rests on the plane portion 24, the springs 10 and 11 are slightly compressed and the spring 11 is in contact with the contact 15: the bulb 7 is switched on. To switch it off, it is necessary only to rotate the battery in the opposite direction about the axis 2.

To remove the battery, it is then necessary to compress the springs 10 and 11 to allow the protruding portion 16 to pass over the boss 21, then to guide the battery along the rib 19.

There is nothing in the external design of the housing which is suggestive of the above operations, which cannot therefore be carried out by someone who has not learnt to do so.

Of course, the invention is not limited to the embodiment which has just been described. The ribs, grooves and notches previously described and forming a part of the inside surface of the lantern housing and of the battery casing respectively can be replaced by complementary configurations which allow analogous guiding which is not identifiable from the outside of the housing. Instead of being carried on a plate which forms a lid, these configurations could, for example, be carried by a side portion of the battery.

We claim:

1. A battery-operated lantern comprising:

a housing having a circumferential wall extending about a central axis, a support member positioned transversely to said axis and defining one end of a battery compartment inside the circumferential wall of said housing, the battery compartment having an open end opposite said support member, first guide means in the battery compartment extending parallel to the axis along the inside surface of the circumferential wall, second guide means in the battery compartment extending circumferentially around the inside surface of said wall, and a stop means on the inside surface of said wall and spaced circumferentially from the first guide means;

a light bulb mounted on said support means on the opposite side thereof from the battery compartment;

a pair of electrical contacts mounted in the battery compartment and conductively connected to the light bulb;

an electric battery removably positioned in the battery compartment, said battery having a pair of terminals; and follower means associated with said battery for slidably engaging said first guide means for permitting said battery to be axially inserted into or withdrawn from the battery compartment at a first predetermined angular position, for slidably engaging the second guide means when the battery is inserted a predetermined distance into the battery compartment for permitting said battery to be rotated inside the said compartment between the first angular relation and a predetermined second angular relation at which the battery terminals conductively touch said electrical contacts, and for engaging said stop means when the battery is in said second angular position.

2. A lantern according to claim 1 wherein said battery terminals do not touch said contacts when the battery is rotated from said second position by an angle less than the angle between the first and second positions, thereby permitting the lantern to be switched on and off by rotating the battery without removing it from the housing.

3. A lantern according to claim 1 wherein said first guide means comprises a generally axially extending rib formed on the inner surface of said circumferential wall, and said follower means comprises a notched projection from said battery, the notch of said projection being slidably engageable with said rib.

4. A lantern according to claim 1 wherein said first guide means comprises a generally axially extending slot formed in the inner surface of said circumferential wall, and said follower means comprises a projection from said battery, said projection being slidably engageable with said slot.

5. A lantern according to claim 4 wherein the slot of said first guide means extends from the open end of the battery compartment and terminates at a location axially spaced from said support member, and said second guide means comprises a circumferential ledge extending from the terminus of said slot in a plane approximately perpendicular to said axis.

6. A lantern according to claim 5 further comprising a boss extending axially from the plane of said ledge toward said supporting member adjacent to the terminus of said slot.

7. A lantern according to claim 6 wherein said follower means comprises a plate of insulating material fastened to said battery, and said terminals are secured onto said plate.

8. A lantern according to claim 7 wherein said terminals comprise springs, and said ledge and said boss are spaced from supporting member such that the springs are slightly compressed and strongly compressed when said insulating plate engages said ledge and said boss, respectively.

9. A lantern according to claim 1 wherein said first guide means comprises a pair of slots in the inner surface of the circumferential wall positioned on opposite sides of and parallel to said axis; said second guide means comprises a pair of circumferential slots in the inner surface of said circumferential wall, each circumferential slot intersecting a corresponding one of said axial slots; and said follower means comprises a flat plate attached to the battery, said plate having opposed extensions which are sized to slidably engage said axial slots and said circumferential slots.

10. A lantern according to claim 9 wherein said first guide means further comprises an axial rib protruding from the inner surface of one of said axial slots, and wherein one of the opposed extensions of said flat plate has a notch corresponding to said rib, whereby the battery can be inserted into the battery compartment at only one angular position.

11. An electric lantern according to claim 1 wherein said housing is made in one piece and includes an enclosed lamp compartment, separated from said battery compartment by said support member.

* * * * *